United States Patent [19]

Treat

[11] 4,027,512

[45] June 7, 1977

[54] LUBRICANT-COOLANT EMULSION ADDITIVE FOR METAL WORKING OPERATIONS

[75] Inventor: Lyle G. Treat, Midland, Mich.

[73] Assignee: The Dow Chemical Company, Midland, Mich.

[22] Filed: May 4, 1976

[21] Appl. No.: 683,122

[52] U.S. Cl. ..... 72/42; 252/49.5

[51] Int. Cl.[2] ..... C10M 1/06; C10M 1/08

[58] Field of Search ..... 72/42, 46; 113/120 A; 252/49.3, 49.5

[56] References Cited

UNITED STATES PATENTS

| | | | |
|---|---|---|---|
| 3,033,785 | 5/1962 | Bennett | 252/49.5 |
| 3,374,171 | 3/1968 | Davis | 252/49.3 |
| 3,408,843 | 11/1968 | Treat | 72/42 |
| 3,409,551 | 11/1968 | Treat | 252/49.5 |
| 3,429,815 | 2/1969 | Drake | 252/49.5 |
| 3,835,052 | 9/1974 | McDole et al. | 252/49.5 |
| 3,933,661 | 1/1976 | Abrams et al. | 252/49.5 |

*Primary Examiner*—E. M. Combs

*Attorney, Agent, or Firm*—G. H. Korfnage; Bruce M. Kanuch

[57] ABSTRACT

Method for adding a fatty acid to an oil-in-water type emulsion during use without detrimentally affecting the properties of the emulsion, comprising providing a solution of (A) the fatty acid and (B) a liquid in which the fatty acid is readily soluble, selected from the group consisting of at least one polyoxyalkylene glycerol, at least one monoalkyl ether of a polyoxyalkylene glycol where the alkyl group has at least four carbon atoms and the alkylene group has at least two repeating units, and diethylene glycol di-t-butyl ether, and adding said solution to the emulsion.

36 Claims, No Drawings

LUBRICANT-COOLANT EMULSION ADDITIVE FOR METAL WORKING OPERATIONS

BACKGROUND OF THE INVENTION

This invention relates to oil-in-water lubricant-coolant emulsions used in metalworking operations (hereinafter, "emulsion (s)") such as rolling, cutting cupping, drawing and ironing, milling, scalping, drilling, grinding, punching, and the like. In particular, it relates to a method for adding a fatty acid to such emulsions, thereby maintaining a preselected level of lubricity agent in the emulsion.

In methods of shaping metals in which lubrication is required, it has become common practice to use emulsions in place of prior used non-aqueous hydrocarbon lubricants. For example, in rolling a metal such as aluminum, magnesium, or steel through steel work rolls it is usual to use an emulsion to flood the tool and the workpiece. As used herein "tool" is used broadly to refer to any piece of equipment with which the metal is in contact during the metalworking operation, e.g., rolls, punches, dies, drills, cutting devices, grinding devices, and the like. The emulsion serves the dual function of both coolant and lubricant. As a coolant in cutting operations, the emulsion helps to control the temperature of the cutting tool. As a coolant in other shaping operations, for example, in rolling, the pattern of distribution of the emulsion on the work rolls is regulated to control the temperature gradient of the rolls transversely to the work stock and hence the shape of the rolls is controlled. The rate of flow of the emulsion onto the metal being shaped regulates the temperature thereof during the various stages of shaping.

As a lubricant, the emulsion serves: (1) to control the frictional forces existing between the workpiece and the tool; (2) to promote the development of desired tool coatings during the shaping process, e.g., rolled-coating during rolling; (3) to prevent excessive transfer of metal from the workpiece to the tool or from the tool to the workpiece, e.g., between the rolls and the workpiece as in rolling operation; and (4) to facilitate removal of the workpiece from the tool, e.g., as in punching operations.

Typical emulsions that have been used for metal shaping operations such as rolling or cutting have consisted essentially of from about 0.5 to 20% by weight of an oil in the water, the oil being a mixture referred to in the trade as a neat soluble oil or simply soluble oil. Such neat soluble oil is widely sold as a concentrate containing, generally, about 70–90 percent by weight of a base oil, such as a light mineral oil, from about 1 to about 20 percent by weight, based on said neat soluble oil, of one or more anionic and/or nonionic oil-in-water emulsifying agents and the balance substantially water. For most metal shaping operations, the neat soluble oil must contain from about 0.5 to about 15 percent by weight lubricity additives such as long chain alcohols, e.g., $C_{12}$ to $C_{16}$ alcohols, long chain fatty acids, e.g., $C_{12}$ to $C_{22}$ acids such as oleic acid, and salts or esters thereof, e.g., alkanolamine soaps, or, esters such as butyl stearates which serve as extreme pressure agents. Emulsions are made up conventionally by admixing one of the commerically available substantially water-free concentrates with water. The commercial concentrates usually contain up to 0.5 percent by weight of a bactericide and from about 0.5 to about 5 percent by weight of a coupling agent, i.e., a substance which stabilizes the concentrate during storage prior to use.

Since, as will become apparent, this invention employs an additive solution as a means for controlling the concentration of a lubricity additive, i.e., the active ingredient in the oil phase of the emulsion, to avoid confusion the phrase "lubricity agent (s)" is used hereinafter to refer to the active component usually referred to in the trade as "lubricity additive". "Fatty acid-type lubricity agent (s)" refers to long chain fatty acids and mixtures thereof, and may, but need not necessarily, include one or more alkali metal or ammonium salts thereof. "Free fatty acid(s)" refers to long chain fatty acids and mixtures thereof, substantially free from their corresponding alkali metal and ammonium soaps.

The composition of the neat soluble oil itself forms no part of the present invention. The method and composition of the invention are usable with substantially all of the commonly known and used, commercially available neat soluble oils, without modification of the soluble oil per se.

Representative commercial compounded oils, i.e., soluble oils, include, for example, Solvac 1535G, Prosol 44, Prosol 66, Prosol 172, and Mobil 200C, all supplied by Mobil Oil Company; Rollex A supplied by the Shell Chemical Company; RolKleen No. 53 supplied by the D. A. Stuart Oil Company, Limited; A-100 supplied by the Far Best; Tandemol C86 and Tandemol K87 supplied by E. F. Houghton and Company; Texaco 591 supplied by Texaco, Inc.; and Quakerol 538 supplied by the Quaker Chemical Corporation.

A typical neat soluble oil that is commercially available has the following general composition, by weight:

| Components | Percent |
|---|---|
| Light Mineral Oil | 83 |
| Lubricity Agents | 11 |
| Emulsifiers | 4 |
| Coupling Agents | 0.5 |
| Bactericide | 0.5 |
| Detergent | 1 |

The base oil used in making up a neat soluble oil generally is selected from a light hydrocarbon or light hydrocarbon mixture having a viscosity of about 40 to 200 Saybolt Universal Seconds (SUS) at 100° F. However, other lubricious materials such as fatty oils, e.g., palm oil, or synthetic materials, e.g., palm oil substitutes are also used as a base oil making up soluble oil. Such other lubricity materials may have viscosities as high as about 850 SUS.

For the purposes of the following description and the appended claims, the term base oil is understood to encompass the light hydrocarbon or hydrocarbon mixtures recognized as light mineral oils, in addition to lubricious materials including vegetable oils, such as palm oil, animal fats such as lard oil, and palm oil substitutes and the equivalents thereof, e.g., polyglycols and ethers and esters thereof, silicones and polysilicones, carbonates, mercaptals, formals, and other synthetic lubricating oils known to the art, selected from those which are non-staining of the particular metal being shaped.

Suitable anionic oil-in-water emulsifiers used in sufficient amount to emulsify the base oil include, for example: (1) alkylarylsulfonates such as the higher alkylbenzene sulfonates wherein higher alkyl means an alkyl group having at least 8 carbon atoms, e.g., $C_{12}H_{25}C_6H_4SO_3Na$; (2) fatty alkyl sulfates such as $CH_3(CH_2)_{10}OSO_3Na$; (3) the sulfonated fatty amines such as $C_{17}H_{33}CON(CH_3)C_2H_4SO_3Na$; (4) the alkali metal salts of sulfonated fatty acids; and the like. The other alkali metal salts of these compounds and the triethanolamine salts are equivalents of the sodium salts described above. The alkanolamine soaps of long chain fatty acids are particularly suitable, e.g., diisopropanolamine, diethanolamine or monoethanolamine salts of oleic acid, palmitic acid or stearic acid, the salts being useful singly or as mixtures.

Suitable nonionic oil-in-water emulsifiers include the nonionic ethers such as those derived from alkylphenols and ethylene oxide, e.g., $C_8H_{17}C_6H_4OC_2H_4(OC_2H_4)_xOH$ wherein $x$ has a value of 9 to 14 or more, the primary alcohol-ethylene oxide adducts, and the secondary alcohol-ethylene oxide adducts.

When one of the described emulsions is placed in service in metal shaping operations it tends to work well initially both as a coolant and as a lubricant; in fact, it is commonly observed that the metal surface obtained in metal shaping operations is improved after several days of using the emulsion. The effectiveness of emulsions as lubricants, however, has been observed to deteriorate thereafter. Use of filtration techniques combined with control of water hardness, such as taught in U.S. Pat. Nos. 3,408,843 and 3,409,551, greatly prolongs the life of an emulsion, and is certainly preferred even when using the present invention. Nevertheless, a decrease in the quality and capacity of production occurs where only filtration and control of hardness is used.

Some degree of success has been achieved in control of emulsions by monitoring and adjusting of pH, by adding base oils and/or emulsifiers to control the oil particle size, and the amount of free oil (i.e., non-emulsified) and emulsified oil in the system, and the like.

It has also been realized that control of the balance of the various lubricity agents (not to be confused with the base oil) in the oil phase is critical, and it is this aspect which is the subject of the present invention. As an emulsion is used, the lubricity agents are gradually depleted, for example, by carry out on the workpiece, by degradation by bacteria and heat, by reaction with metal fines and other contaminating substances, and the like. Moreover, particicularly where an emulsion is used wherein the emulsified oil phase comprises a relatively low percentage of the total emulsion, various oils entering the system, such as leaking gear lube oil, hydraulic oil, and the like, can act as diluents of the lubricity agents.

To further explain this latter point, for any given operation, it is known there is an optimum range of emulsified oil content in the emulsion. As oil is carried out on the workpiece, neat oil containing the lubricity agent can be added to the emulsion to restore both the oil level and the lubricity agent, assuming there is no oil leaking into the system. Where oil is leaking into the system, however, as is most always the case, the leaking oil usually does not contain the required lubricity agents. Moreover, while much of it separates as free oil, at least some of the leaking oil becomes emulsified in the system, by design or naturally. Particularly where an emulsion is employed where the emulsified oil content is designed to be relatively low, e.g., on the order of 2 to 12 weight percent of the emulsion, the net result is that the amount of newly emulsified oil entering the system through leakage represents a significant fraction of that lost through carryout. Consequently, little neat oil containing the lubricity agent can be added without upsetting the oil:water ratio, so that while the total amount of emulsified oil remains more or less constant or is depleted at a relatively slow rate, the lubricity agent is depleted at a much faster rate. Unless the proper balance of lubricity agents is restored, a host of problems arise, such as excessive tool wear, scratching of the surface of the workpiece, and in extreme cases, actual tearing or wrinkling of the workpiece, and the like.

Any substance which is added to the emulsion actually first contacts the continuous aqueous phase. The various lubricity agents, however, must be worked into the discontinuous oil phase, or at least onto the oil droplet surface, to be effective. Thus, it is not surprising that poor additive recovery is obtained where attempts have been made to add the additive directly to the emulsion. That others not practicing this invention are experiencing such difficulties has been illustrated recently in a paper by R. G. Tidwell, "Modern Hot Mill Emulsion Controls", presented in May, 1975, at the 1975 Annual Meeting of the American Society of Lubrication Engineers Non-Ferrous Metals Council wherein it was stated "A 50 percent recovery [i.e. effective incorporation into the oil phase of the emulsion] of most fatty additives will generally be a good recovery". In the same paper Tidwell suggests a 75 percent recovery can be realized if the additives are added to neat oil and then made into an emulsion in a tank equipped with an agitator and a heat source. Nevertheless, the inability to easily add lubricity agents to the emulsion leads to waste of raw materials, premature disposal of emulsions, variations in product quality, loss of production, and generally inefficient operation.

SUMMARY OF THE INVENTION

The present invention comprises adding to a neat oil-in-water emulsion, an additive solution comprised of: as Component A, at least one free fatty acid; and as Component B, a liquid in which Component A is readily soluble, and preferably miscible, said Component B being selected from the group consisting of at least one polyoxyalkyleneglycerol, at least one monoalkyl ether of a polyoxyalkylene glycol where the alkyl group has at least four carbon atoms and the alkylene group has at least two repeating units, and diethylene glycol di-t-butyl ether. Component B should be compatible with the total system at the temperatures and at the concentrations at which it is likely to be employed in the emulsion. The concentration of free fatty acid in the additive solution and the amount of additive solution employed are mutually selected so that sufficient lubricity agent is added to the emulsion to attain a preselected concentration of fatty acid type lubricity agent(s) in the oil phase of the emulsion without adversely affecting the emulsion.

FURTHER DESCRIPTION OF THE INVENTION

Component A must be a stable liquid at temperatures likely to be attained in the emulsion, i.e., both at about the time of emulsion contact with the tool and the workpiece, and also during any recirculation steps which might be practiced such as filtering, settling, skimming, or the like. Thus, it should have a melting point of about room temperature, i.e., 20° C, or less; lubricity agents having a somewhat higher melting point can be employed if precautions are taken to assure the emulsion is not allowed to cool below that temperature, but such alternatives may not be practical from an economic standpoint. By "stable liquid" is meant that at the temperature of the emulsion, the lubricity agent must not decompose to products which are of no benefit in the emulsion, or rapidly vaporize. It is not practical to set a quantitative limit on the maximum temperature likely to be attained in the emulsion, as those skilled in the art realize such temperatures will vary over a considerable range depending on the particular operation being carried out. Where the Component A is comprised of a mixture of two or more 12–22 carbon atom fatty acids, the mixture should have a melting point of about 20° C or less.

As hereinabove described, certain free fatty acids, e.g. oleic acid, as well as their corresponding alkali metal and ammonium soaps are known lubricity agents. Such free fatty acids can be readily replenished in oil-in-water emulsions by adding to such an emulsion, while in use, an effective amount of a solution of the desired free fatty acid and Component B. Depending on the pH of the emulsion and assuming the presence of alkali metal and/or amine compounds in the emulsion, the free acid can also be added to control the concentration of both the acid and the respective soaps since an equilibrium between the free acid and the soaps is reached, the acid:soap ratio being determined principally by the pH of the system. While the acid:-soap ratio can be altered by varying the pH of the emulsion, those skilled in the art will recognize that depending on the particular metalworking operation, a somewhat limited pH range is often dictated by other considerations such as susceptibility of the metal of the workpiece to corrosion.

To further illustrate, a preferred emulsion for use in the manufacture of two-piece aluminum cans is one containing from about 5 to 15 weight percent emulsified oil, wherein the base oil of the neat oil is a mineral oil. The pH of such an emulsion is preferably about 8 to about 9. Free oleic acid in solution with a Component B is added to the emulsion according to the present invention to maintain both the level of free oleic acid at from about 1.5 to about 10 weight percent of the emulsified oil phase, as well as the total concentration of free oleic acid and oleic acid soaps at from about 6 to about 13 weight percent of said oil phase. Experience to date indicates optimum performance is realized when said levels are maintained at about 3–8 percent and about 7–10 percent, respectively, for aluminum and predominately aluminum (i.e. at least about 50 weight percent) alloys. Similarly, by adding the free acid to an emulsion according to the present invention, the total free acid and soap concentration particularly suited for any specific operation may be maintained, e.g., about 1–3 weight percent of the oil phase of the emulsion for hot rolling of aluminum (including predominantly aluminum alloys) on a reversing mill, about 3–5 percent for hot rolling of aluminum on a tandem mill, about 8–14 percent for cold rolling of steel on a tandem mill, and the like.

Various suitable analytical techniques are known for use in determining the concentration of various lubricity agents present in an emulsion. Wet methods involving titrations may be used if desired, but modern instrumental methods, such as infrared absorption, are much easier if the necessary instruments are available to the user, and such methods tend to be more accurate as opportunity for human error is minimized. For example, the following procedures have been used in determining the concentrations of free oleic acid, and free oleic acid plus soaps thereof, as expressed herein.

Free oleic acid was determined by extracting a representative sample of the emulsion having a known weight, with a known volume of carbon tetrachloride. A portion of the carbon tetrachloride extract was transferred to a vial containing sodium chloride to absorb any entrained water, and thence to an optical cell for determination of optical density at 1710 $cm^{-1}$, an absorption band characteristic of oleic acid. The optical density was compared with a standard curve to give the concentration of free oleic acid. A second representative sample was subjected to the same steps, except that prior to the extraction step, the second sample was contacted with concentrated hydrochloric acid to convert any soaps to the free acid form. From the optical density measurement, the total percent free oleic acid and oleic acid soap concentration was determined.

Component B should be sufficiently effective as a solvent so that the necessary amount of Component A can be added to the emulsion without also adding so much of Component B that the emulsion is adversely affected. Preferably, Component B is selected so that a homogeneous solution can be prepared—at some temperature within the range of from about 20° C up to about the temperature of the emulsion to which the solution is to be added—containing at least about 5 weight percent and more preferably at least about 25 weight percent Component A. Most preferably, Components A and B are completely miscible with one another.

In proportions in which it is necessary to add Component B to the emulsion as a vehicle for introducing Component A into the emulsified oil phase, Component B must be compatible with the emulsion, e.g., it must not cause the emulsion to become appreciably more tight (smaller oil globule size) nor appreciably more loose (larger oil globule size), nor worse yet, cause the emulsion to break. Similarly, at such concentrations it must be compatible with the workpiece and with the tool used in the metalworking operation, e.g., it must not cause undue corrosion or staining of the various metal surfaces.

Diethylene glycol di-t-butyl ether is suitable for use herein as Component B, as are monoalkyl ethers of polyoxyalkylene glycols where the alkyl group has at least four or more carbon atoms and the alkylene group has at least two repeating units, such as diethylene glycol n-butyl ether and higher homologs thereof which are liquids under the conditions hereinabove specified.

A preferred Component B for use herein, particularly with oleic acid, is a polyoxyalkylene glycerol of the formula $$\begin{array}{l} H_2CO(C_2H_4O,C_3H_6O)_yH \\ | \\ HCO(C_2H_4O,C_3H_6O)_yH \\ | \\ H_2CO(C_2H_4O,C_3H_6O)_yH. \end{array}$$

Preferably the polyoxyalkylene glycerol has a molecular weight within the range of from about 2000 to about 3000, most preferably about 2600. When a filtered, recirculating metalworking emulsion is treated periodically with a solution of 1 part by volume oleic acid per about 0.1 to about 20 parts by volume of such a glycerol, preferably 1 part by volume oleic acid per 0.2 to 2 parts by volume of such a glycerol, over a sustained period, higher production is attained following commencement of such treatment than without such treatment, the emulsion becomes cleaner indicating fewer fines are being generated in the metalworking operation, the amount of unemulsified tramp oil is reduced, and the emulsion is more easily filterable, i.e., a lesser pressure is required to maintain the same rate of flow. Such a mixture (1 part oleic acid and about 0.2 to 2 parts of the polyoxyalkylene glycerol) is readily stored in conventional steel drums for extended periods of 6 months or more without significant corrosion. Six month laboratory immersion tests of coupons of 3004 aluminum alloy and mild steel, run at ambient temperature also showed no detectable corrosion.

As a practical matter, it is preferred to add as much Component A to the emulsion as necessary to attain the preselected level of lubricity agent in the emulsified oil phase, using as little of Component B as possible. Use of excess Component B is economically unsound; moreover whenever one adds another component to an already complex emulsion, there is always a risk that an extreme excess may detrimentally affect the emulsion. If Component A is not completely dissolved in the solution to be added, i.e., if a homogeneous solution is not attained, a larger proportion of Component B, or alternatively use of a different Component B, is called for. An increase in the amount of unemulsified water-immiscible components in the emulsion system shortly after an addition of the additive solution, much of which is believed attributable to unemulsified lubricity agent, indicates a need for a greater proportion of Component B in the additive. Such an increase can be observed by microscopic examination of a sample of the emulsion. In extreme cases, such an increase of unemulsified substances can readily be observed in fresh emulsions, i.e., having substantially no fines to impart a gray color, by a slight color change in the emulsion e.g. a change from off white to slightly yellow, or even by the appearance of oily globules on the surface. A slight amount of experimentation may be required to arrive at an optimum ratio of Component A to Component B depending on the particular components being employed as well as the particular emulsion being treated. Subject to the foregoing functional limitations, a suitable ratio is generally from about 0.1 to about 20 parts of Component B by volume, per part of Component A, the upper limit, i.e., 20, being practical rather than critical. A preferred Component B to Component A ratio is from about 0.2:1 up to 2:1, which, without being unduly wasteful, provides a comfortable excess of Component B over the minimum amount necessary to assure the Component A is substantially completely taken up in the emulsified oil phase.

The additive solution may be added to the emulsion periodically as needed to maintain the concentration of fatty acid-type lubricity agent (s) within a preselected operating range. Alternatively, the additive may be introduced continuously at a suitable rate if desired. Preferably, the addition is made at or in proximity to a point of agitation in the emulsion system, e.g. near a pump intake port.

The practice of the present invention is further illustrated by the following examples.

COMPARISON SHOWING DEPLETION OF LUBRICITY AGENT

A 6000 gallon stable-to-filtration oil-in-water emulsion containing about 14±2 weight percent Prosol 172 oil, a mineral oil based neat oil sold by Mobil Oil Co., containing about 6.5 to about 7 weight percent total oleic acid and oleic acid soaps, virtually all of which are initially present as the soaps, was used for making bodies for two-piece aluminum cans by the draw and iron process. About 1.5 million cans per day were made, with the emulsion being treated using the technology of U.S. Pat. Nos. 3,408,843 and 3,409,551, i.e., stabilization and fine filtration through diatomaceous earth filters. Over the course of a week, there was a leakage of about 630 gallons of gear lube oil into the the approximately 6000 gallon emulsion. During this time about 350 gallons of the neat soluble oil was added, mostly coming into the system from the lubrication of the cups, i.e., the workpiece. The lubricity agents in the coolant-lubricant became out of balance principally, it is believed, as a result of the leakage of gear lube oil into the coolant. Using infrared absorption, it was determined that the total lubricity agent in the circulating emulsion had dropped to 4.25 weight percent of the emulsified oil phase. This lowered lubricity agent content affected the operation of the body makers, also known as the ironers.

LABORATORY RUNS

Various compounds were evaluated as carriers for use with oleic acid. Solutions were prepared containing two parts carrier, by volume, per part of oleic acid. Emulsions were prepared containing water and, based on the total weight of the emulsion, 10 percent Texaco 591 neat oil, which is a mineral oil based neat oil containing about 7 percent by weight total oleic acid plus oleic acid soaps, substantially all of said 7 percent being present in the soap form. The solutions were slowly added to respective samples of the emulsion, with continuous agitation, in amounts so that based on the original weight of the oil phase in each sample, an additional 1, 5, and 10 percent oleic acid was added to respective samples. As a control, oleic acid was added directly, i.e. without a carrier vehicle, to three samples of emulsion in amounts of 1, 5, and 10 percent respectively. In each instance, agitation was continued for about 5 minutes after addition of the additive, and the sample placed in a clean laboratory bottle for storage.

A polyoxyalkylene glycerol of the type hereinabove described having a nominal average molecular weight of about 2600, diethylene glycol n-butyl ether, and diethylene glycol di-t-butyl ether were each found to be effective as carrier vehicles for oleic acid. Such solutions were all readily taken up by the emulsion at all three levels of additive addition, and remained stable even after 16 weeks without agitation, except at the 15 percent level where slight creaming eventually occurred in each. By "slight creaming" is meant the sample showed no sharp line of separation or increase in particle size upon viewing without magnification, although that part of the emulsion near the top of the bottle was slightly different in appearance from that more near the bottom. The creaming was not so severe as to be considered an unacceptable separation, and a uniform emulsion was once again immediately obtained upon mild agitation.

In contrast, a slight separation was observed within a few minutes agitation was ceased, in the control to which had been added only 1 percent oleic acid without a carrier. Large, clear yellow oil puddles, e.g., several had diameters of 1 to 5 millimeters or more, formed on the surface of the control to which had been added 10 percent oleic acid without a carrier. The control to which had been added 15 percent oleic acid without a carrier developed a yellow oil slick covering almost the entire surface of the fluid.

From the foregoing, it is readily apparent that oleic acid is much more effectively added to a neat oil-in-water lubricant-coolant emulsion using the method of the present invention than by adding the oleic acid directly to the emulsion.

Other compounds tested in a similar manner and found to be ineffective, or at best of only negligible effectiveness, in enhancing the incorporation of oleic acid into such an emulsion included ethylene glycol methyl ether and diethylene glycol ethyl ether (both monoalkyl ethers of a polyoxyalkylene glycol, but having less than four carbon atoms in the alkyl group); diethylene glycol methyl t-butyl ether (a dialkyl rather than a monoalkyl ether); and bis-[2-(methoxyethoxy)ethoxy] methane.

What is claimed is:

1. A method for adding a substantially water-immiscible fatty acid-type lubricity agent to the discontinuous neat oil phase of a neat oil-in-water lubricant-coolant emulsion for use in metalworking operations wherein a workpiece is contacted by a tool, comprising adding a solution to the emulsion, said solution comprising A. at least one free fatty acid and B. a liquid in which said Component (A) is readily soluble, selected from the group consisting of (i) at least one polyoxyalkylene glycerol, (ii) at least one monoalkyl ether of a polyoxyalkylene glycol where the alkyl group has at least four carbon atoms and the alkylene group has at least two repeating units, and (iii) diethylene glycol di-t-butyl ether, said liquid being further characterized in that it is compatible with the emulsion, with the workpiece, and with the tool, the concentration of Component (A) in the solution and the amount of solution added to the emulsion being mutually selected so that sufficient fatty acid-type lubricity agent is added to the oil phase of the emulsion to attain a preselected concentration of the fatty acid-type lubricity agent in the oil phase of the emulsion without adversely affecting the emulsion.

2. The method of claim 1 wherein the neat oil contains a light mineral oil as a base oil.

3. The method of claim 1 wherein Component (A) is characterized by a melting point of about 20° C or less.

4. The method of claim 3 wherein Component (A) is oleic acid.

5. The method of claim 1 wherein Component (B) is diethylene glycol di-t-butyl ether, diethylene glycol n-butyl ether, or a polyoxyalkylene glycerol of the formula $$\begin{array}{l} H_2CO(C_2H_4O,C_3H_6O)_yH \\ | \\ HCO(C_2H_4O,C_3H_6O)_yH \\ | \\ H_2CO(C_2H_4O,C_3H_6O)_yH. \end{array}$$

6. The method of claim 5 wherein Component (A) is oleic acid.

7. The method of claim 5 wherein Component (B) is a polyoxyalkylene glycerol of the formula $$\begin{array}{l} H_2CO(C_2H_4O,C_3H_6O)_yH \\ | \\ HCO(C_2H_4O,C_3H_6O)_yH \\ | \\ H_2CO(C_2H_4O,C_3H_6O)_yH \end{array}$$

having a molecular weight within the range of from about 2000 to about 3000.

8. The method of claim 7 wherein Component (A) is oleic acid.

9. The method of claim 7 wherein the solution contains from about 0.1 to about 20 parts of the glycerol per part of Component (A), by volume.

10. The method of claim 9 wherein the solution contains from about 0.2 to about 2 parts of the glycerol per part of Component (A), by volume.

11. The method of claim 7 wherein the molecular weight of the glycerol is about 2600.

12. The method of claim 11 wherein Component (A) is oleic acid and wherein the neat oil contains a light mineral oil as a base oil.

13. The method of claim 12 wherein the solution contains from about 0.2 to about 2 parts of the glycerol per part of oleic acid, by volume.

14. In a method for working metals wherein the metal is substantially simultaneously contacted with a tool and a neat oil-in-water lubricant-coolant emulsion containing at least one water-immiscible fatty acid-type lubricity additive in the oil phase of said emulsion, wherein the coolant is collected, filtered and reused in a continuous system, and wherein the lubricity additive is subjected to depleting conditions as the emulsion is used, the improvement which comprises:

maintaining a preselected concentration of the lubricity additive in the oil phase of the emulsion by adding to said emulsion, an additive solution comprised of A. at least one free fatty acid, and B. a liquid in which said Component (A) is readily soluble, selected from the group consisting of (i) at least one polyoxyalkylene glycerol, (ii) at least one monoalkyl ether of a polyoxyalkylene glycol where the alkyl group has at least four carbon atoms and the alkylene group has at least two repeating units, and (iii) diethylene glycol di-t-butyl ether, said liquid being further characterized in that it is compatible with the tool, with the metal being worked, and with the emulsion, the concentration of Component (A) in the solution and the amount of solution added to the emulsion being mutually selected so that sufficient fatty acid-type lubricity agent is added to the oil phase of the emulsion to attain a preselected concentration of the fatty acid-type lubricity agent in the oil phase of the emulsion without adversely affecting the emulsion.

15. The method of claim 14 wherein the metal being worked is aluminum or a predominately aluminum alloy.

16. The method of claim 15 wherein the aluminum is worked by rolling.

17. The method of claim 15 wherein the aluminum is worked into the shape of a body for a can, using a draw and iron process.

18. The method of claim 14 wherein the metal being worked is steel.

19. The method of claim 18 wherein the steel is worked by rolling.

20. A method for maintaining a preselected amount of free oleic acid and soaps thereof in the oil phase of a recirculating, stable-to-filtration, neat oil-in-water lubricant-coolant emulsion for use in metal-working operations wherein a workpiece is contacted with a tool, comprising adding to said emulsion while said emulsion is in use, an additive solution comprised of A. oleic acid and B. a liquid in which the oleic acid is readily soluble, selected from the group consisting of (i) at least one polyoxyalkylene glycerol, (ii) at least one monoalkyl ether of a polyoxyalkylene glycol where the alkyl group has at least four carbon atoms and the alkylene group has at least two repeating units, and (iii) diethylene glycol di-t-butyl ether, said liquid being further characterized in that it is compatible with the emulsion, with the workpiece, and with the tool, the concentration of the oleic acid in the solution and the amount of solution added to the emulsion being mutually selected so that when a soap:free acid equilibrium is attained, sufficient oleic acid is added to the oil phase of the emulsion to restore the oleic acid and oleic acid soap content of the oil phase to the respective preselected levels.

21. The method of claim 20 wherein the neat oil contains a light mineral oil as a base oil.

22. The method of claim 20 wherein the emulsified neat oil comprises from about 0.5 to about 20 percent by weight of the emulsion.

23. The method of claim 20 wherein the emulsion is employed in the hot rolling of aluminum upon a reversing mill and wherein the total concentration of free oleic acid and oleic acid soap in the neat oil phase in the emulsion is maintained at from about 1 to about 3 weight percent of said phase.

24. The method of claim 20 wherein the emulsion is employed in the hot rolling of aluminum on a tandem mill and wherein the total concentration of free oleic acid and oleic acid soap in the neat oil phase of the emulsion is maintained at from about 3 to about 5 weight percent of said phase.

25. The method of claim 20 wherein the emulsion is employed in the cold rolling of steel on a tandem mill and wherein the total concentration of free oleic acid and oleic acid soap in the neat oil phase of the emulsion is maintained at from about 8 to about 14 weight percent of said phase.

26. The method of claim 20 wherein the emulsion has a pH of from about 8 to about 9 and is employed in an aluminum can making operation; wherein the total concentration of oleic acid and oleic acid soap in the neat oil phase of the emulsion is maintained at from about 6 to about 13 weight percent of said phase; and wherein the concentration of oleic acid is maintained at from about 1.5 to about 10 weight percent of said phase.

27. The method of claim 20 wherein Component (B) is diethylene glycol di-t-butyl ether, diethylene glycol n-butyl ether, or a polyoxyalkylene glycerol of the formula $$\begin{array}{l} H_2CO(C_2H_4O,C_3H_6O)_yH \\ | \\ HCO(C_2H_4O,C_3H_6O)_yH \\ | \\ H_2CO(C_2H_4O,C_3H_6O)_yH. \end{array}$$

28. The method of claim 27 wherein the liquid is a polyoxyalkyalkylene glycerol of the formula $$\begin{array}{l} H_2CO(C_2H_4O,C_3H_6O)_yH \\ | \\ HCO(C_2H_4O,C_3H_6O)_yH \\ | \\ H_2CO(C_2H_4O,C_3H_6O)_yH \end{array}$$

having a molecular weight within the range of from about 2000 to about 3000.

29. The method of claim 28 wherein the neat oil contains a light mineral oil as a base oil, wherein the molecular weight of the polyoxyalkylene glycerol is about 2600, and wherein the additive solution contains from about 0.1 to about 20 parts by volume of said glycerol per part of oleic acid.

30. The method of claim 28 wherein the emulsion is employed in hot rolling of aluminum on a reversing metal and wherein the total concentration of oleic acid and soaps thereof in the neat oil phase of the emulsion is maintained at from about 1 to about 3 weight percent of said phase.

31. The method of claim 28 wherein the emulsion is employed in the hot rolling of aluminum of a tandem mill and where the total concentration of oleic acid and soaps thereof in the neat oil phase of the emulsion is maintained at from about 3 to about 5 weight percent of said phase.

32. The method of claim 28 wherein the emulsion is employed in the cold rolling of steel on a tandem mill and wherein the total concentration of oleic acid and soaps therein in the neat oil phase of the emulsion is maintained from about 8 to about 14 weight percent of said phase.

33. The method of claim 28 wherein the emulsion is employed in an aluminum can making operation; wherein the total concentration of oleic acid and soaps thereof in the neat oil phase of the emulsion is maintained at from about 6 to about 13 weight percent of said phase; and wherein the concentration of oleic acid is maintained within the range of from about 1.5 to about 10 weight percent of said phase.

34. The method of claim 33 wherein the neat oil contains a light mineral oil as the base oil; wherein the emulsified oil phase of said emulsion comprises from about 5 to about 15 weight percent of said emulsion; wherein the total concentration of oleic acid and the soaps thereof in said phase of the emulsion is maintained at from about 7 to about 10 weight percent of said phase; and wherein the concentration of oleic acid is maintained at about 3 to about 8 weight percent of said phase.

35. The method of claim 34 wherein the molecular weight of said glycerol is about 2600 and wherein the additive solution contains from about 0.1 to about 20 parts by volume of said glycerol per part of oleic acid.

36. The method of claim 35 wherein the additive solution contains from about 0.2 to about 2 parts by volume of glycerol per part of oleic acid.

* * * * *

UNITED STATES PATENT AND TRADEMARK OFFICE

CERTIFICATE OF CORRECTION

PATENT NO. : 4,027,512

DATED : June 7, 1977

INVENTOR(S) : Lyle G. Treat

It is certified that error appears in the above-identified patent and that said Letters Patent are hereby corrected as shown below:

Col. 1, line 8, after "cutting" insert -- , --;
Col. 1, line 65, change "commerically" to -- commercially--;

Col. 2, line 52, after "oil" first occurrence, insert -- in --;
Col. 3, line 37, after "adjusting" delete "of" and insert -- the --;
Col. 5, line 40, after "to" insert -- about --;
Col. 8, line 16, after "the" delete "the";
Col. 8, line 55, after "for" insert -- the --;
Col. 9, line 2, after "minutes" insert -- after --;
Col. 12, line 8, Claim 28, delete "polyoxyalkyalkylene" and insert -- polyoxyalkylene --;
Col. 12, line 30, Claim 31, delete "of"second occurrence, and insert -- on --.

Signed and Sealed this

*Fifteenth* Day of *January 1980*

[SEAL]

*Attest:*

SIDNEY A. DIAMOND

*Attesting Officer*

*Commissioner of Patents and Trademarks*